United States Patent [19]

Thomson et al.

[11] Patent Number: 5,065,125

[45] Date of Patent: Nov. 12, 1991

[54] C-, S- AND T-SWITCHES OPERATED BY PERMANENT MAGNETS

[75] Inventors: R. Glenn Thomson; Paul Y. Tsoi, both of Waterloo, Canada

[73] Assignee: Com Dev Ltd., Cambridge, Canada

[21] Appl. No.: 517,590

[22] Filed: May 2, 1990

[30] Foreign Application Priority Data

Apr. 12, 1990 [CA] Canada ..... 2014585

[51] Int. Cl.[5] ..... H01H 51/30

[52] U.S. Cl. ..... 335/5; 335/4; 333/105

[58] Field of Search ..... 333/104–109; 335/4–5, 205–207

[56] References Cited

U.S. PATENT DOCUMENTS

| | | | |
|---|---|---|---|
| 4,199,741 | 4/1980 | Serrus Paulet | 335/206 |
| 4,298,847 | 11/1981 | Hoffman | 335/5 |
| 4,633,201 | 12/1986 | Ruff | 335/4 |
| 4,851,801 | 7/1989 | Engel | 335/230 |
| 4,965,542 | 10/1990 | Nelson | 335/5 |

*Primary Examiner*—Gerald P. Tolin
*Assistant Examiner*—Lincoln Donovan
*Attorney, Agent, or Firm*—Daryl W. Schnurr

[57] ABSTRACT

C-, T- and S-switches have a connector or reed in each conducting path. The connector or reed contains a support for a permanent magnet. All of the magnets of the connectors have the same polarity. The connectors, supports and permanent reed magnets in the supports are contained within an RF cavity housing, which can be completely sealed from an actuator or, alternatively, the housing can be open to the actuator. The actuator has a circular shape and contains permanent magnets that correspond in their configuration to the reed magnets of the housing. At least two magnets of the actuator have different polarities. The actuator can be rotated by a motor to two or more positions. In one position, one or more of the reed magnets are attracted and one or more of the reed magnets are repelled. The switch is designed so that when a reed magnet is attracted, the conducting path in which the connector is located is interrupted and when a reed magnet is repelled, the conducting path is connected. Previous switches are more expensive to manufacture and more complex, thereby increasing the likelihood of premature failure. Previous switches do not have a housing that is completely sealed from an actuator.

16 Claims, 9 Drawing Sheets

PRIOR ART

PRIOR ART

C-, S- AND T-SWITCHES OPERATED BY PERMANENT MAGNETS

BACKGROUND OF THE INVENTION

1. Field of the Invention

This invention relates to a microwave switch and, in particular, to a transfer switch that is an S-switch, a C-switch, a T-switch or the like and is operated by permanent magnets.

2. Description of the Prior Art

Transfer switches such as C-switches, S-switches or T-switches are known and are widely used in the space communications industry. For example, a communications satellite will contain numerous coaxial C-switches, S-switches or T-switches. Previous switches have a larger mass and a much larger volume than switches of the present invention. Further, previous switches are more complex and expensive to manufacture and some previous switches have a relatively large number of moving parts making them more susceptible to failure. In previous switches, an interior of the RF cavity is always open to the actuator resulting in leakage of electromagnetic energy from the cavity. The switch of the present application is an improvement over the switch described in U.S. Pat. No. 4,851,801, entitled "Microwave C-switches and S-switches", naming Klaus G. Engel as inventor and being issued on July 25, 1989.

Mass and volume are always critical parameters for space applications. Any savings in mass and volume are readily converted to cost savings, or higher communications capacity, or longer life for the satellite or a combination of these factors. Similarly, the reliability of space craft components is crucial to the success of the satellite as there are no means for correcting any malfunctions once the satellite is launched.

SUMMARY OF THE INVENTION

The present microwave switch has an RF cavity housing, an actuator and a power means for repositioning said actuator arranged as follows:

(a) The housing has at least two conductor paths interconnecting at least three ports. The housing also contains at least two permanent reed magnets of the same polarity, the reed magnets each having a separate connector thereon. Each connector has a first position and a second position that are linearly displaced from one another, in one position, each connector connecting a conductor path in which said connector is located while in another position each connector interrupting said conductor path;

(b) The actuator has at least two permanent magnets, at least one of said permanent magnets being of opposite polarity to at least one other of said permanent magnets;

(c) The reed magnets of the housing and the permanent magnets of the actuator are located to interact with one another when the actuator is in an appropriate position so that one magnet of said actuator is aligned with a corresponding magnet of said housing;

(d) The magnets of the actuator are arranged with respect to polarity so that when the actuator is moved by the power means to one position, at least one magnet of said actuator attracts a corresponding reed magnet of the housing, thereby causing the connector to either connect or interrupt one conductor path while, simultaneously, another magnet of the actuator repels a corresponding reed magnet of the housing, thereby causing the connector to either interrupt or connect respectively another conductor path;

The movement of all magnets is co-ordinated so that appropriate conductor paths are connected and interrupted simultaneously. The actuator, the power means, the reed magnets and the connectors are the only movable components of the switch. There is no mechanical connection between the magnets of the actuator and the magnets of the housing.

DESCRIPTION OF A PREFERRED EMBODIMENT

Figure 1:
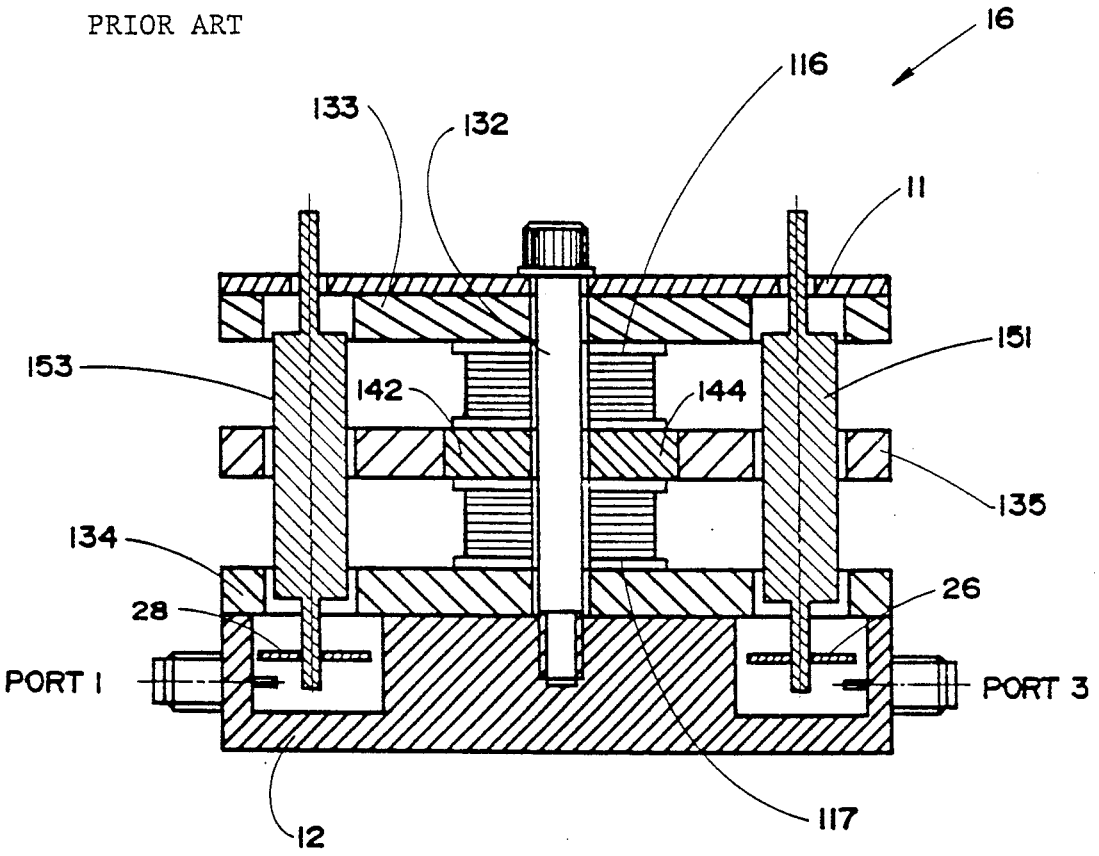
FIG. 1 is a sectional side view of a prior art coaxial S-switch having electromagnetic means to actuate armatures.

In FIG. 1, there is shown a sectional side view of an electromagnetic switch 16 in accordance with the present invention with the RF cavity housing 12 located within a housing 11.

Figure 2:
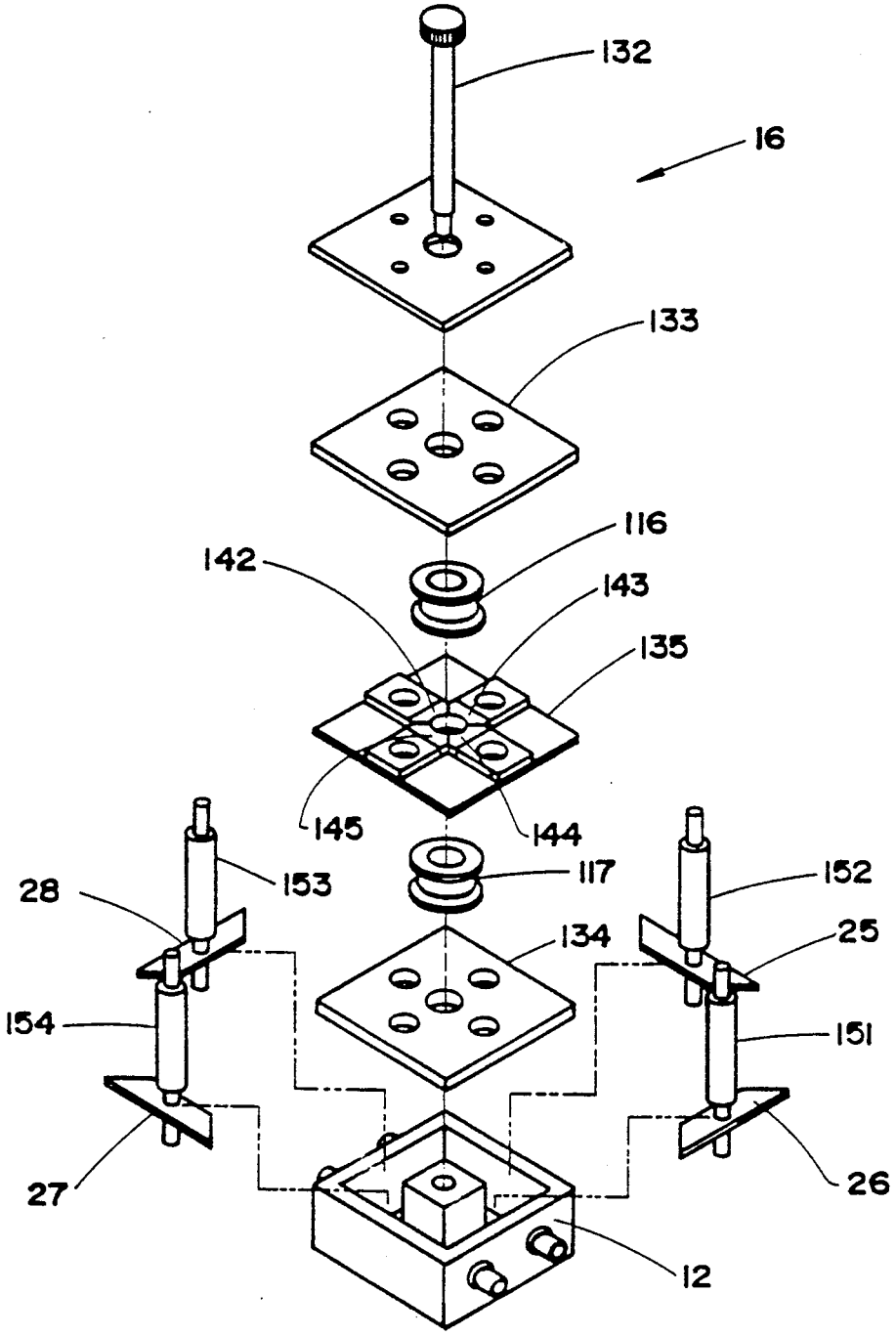
FIG. 2 is a exploded perspective view of the prior art S-switch of FIG. 1.

From FIGS. 1 and 2, it can be seen that the switch 16 has conductor paths located in the RF cavity housing 12. Four movable connectors 25, 26, 27, 28 are shown which are fastened to four armatures 151, 152, 153, 154. The connectors 25, 26, 27, 28 are each long enough to comprise one entire conductor path for the switch 16. The upper and lower magnetic returns 133, 134 are separated by a centre plate 135 and upper and lower windings 116 and 117, respectively. To complete the magnetic circuit the magnetic returns, centre plate 135 and upper and lower windings 116, 117 are fastened with a pin 132 that serves as a back iron to the magnetic circuit. Four permanent magnets 142, 143, 144, 145 are supported on the centre plate 135, one for each of the armatures 153, 152, 151, 154 respectively. The magnets are oriented as such that opposite armatures say 152, 154 experience the same magnetic polarity. The two magnets for the two remaining armatures 151, 153 respectively are oriented with an opposite or opposing magnetic field. In other words, the armatures 152, 154 oppose the armatures 151, 153. An electrical pulse supplied to either of the coil windings 116, 117 will cause one set of opposing armatures 152, 154 to rise, thus disconnecting the attached connector from the respective conductor path in which it is located and interrupting said path. During the execution of the same electrical pulse the remaining pair of armatures 151, 153 will simultaneously lower, thus causing a connection between their respective connectors and conductor paths. The coil windings can be configured to operate the switch to satisfy two principles.

The winding direction of coils 116, 117 can be utilized electrically to function in a series or parallel circuit arrangement. The advantage of an independent coil with the alternative parallel circuit will permit redundance if one coil should fail or an additional margin of the applied voltage with reference to the switching threshold applied voltage.

Figure 3:
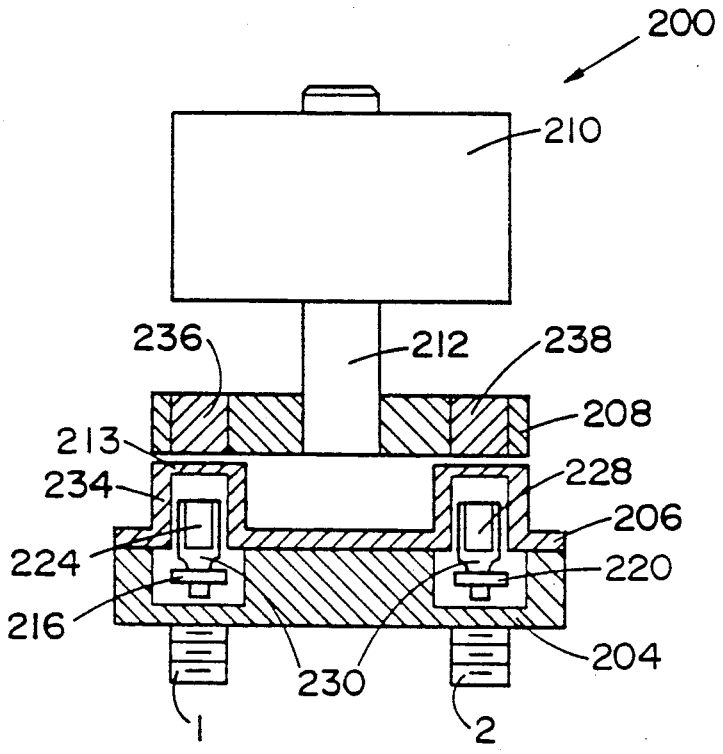
FIG. 3 is a sectional side view of an S-switch in accordance with the present invention where an RF cavity housing is completely sealed from an actuator.
Figure 4:
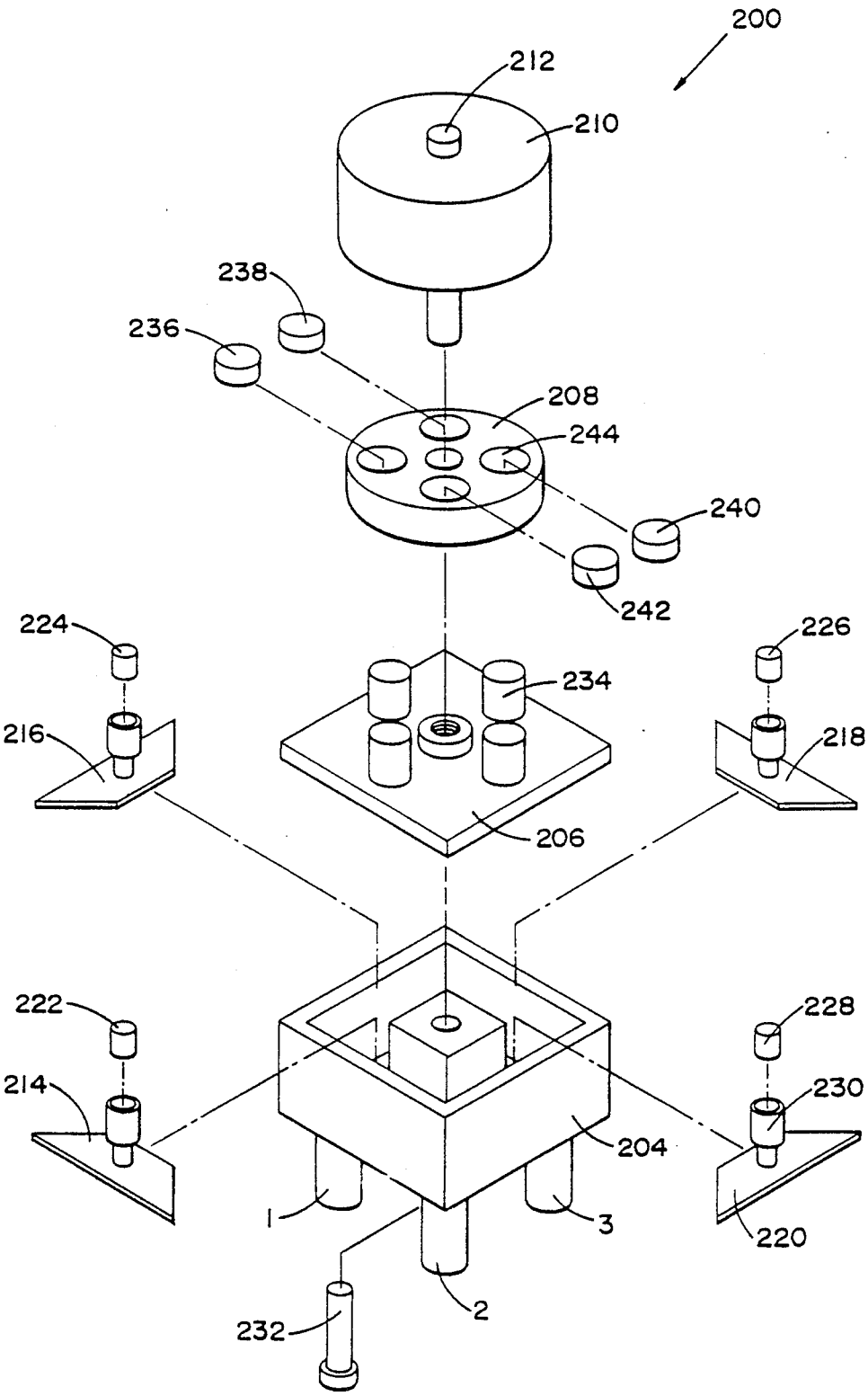
FIG. 4 is an exploded perspective view of a coaxial S-switch in accordance with the present invention.

In FIG. 3, a coaxial C-switch 200 has an RF cavity housing 204 including a cover 206, an actuator 208 and a motor 210. The motor 210 is connected to the actuator 208 by a shaft 212. FIG. 4 shows a perspective view of the switch 200. There is a magnetically transparent wall 213 in the cover 206 of the housing 204.

From FIGS. 3 and 4, it can be seen that the switch 200 has four conductor paths located in the RF cavity housing 204. Four movable connectors or reeds 214, 216, 218, 220 are connected to reed magnets 222, 224, 226, 228 respectively. Each of the connectors 214, 216, 218, 220 contains a support 230 for the reed magnet of that particular connector. Each reed magnet is located approximately at a longitudinal centre of each connector.

The housing 204 contains four ports 1, 2, 3, 4 (only two of which are shown in FIG. 3, and only three of which are shown in FIG. 4). The ports are arranged in a square configuration. The cover 206 can be affixed to the housing 204 in a sealed relationship by a threaded bolt 232. The cover 206 contains four cylindrically-shaped projections 234, the projections being arranged relative to one another so that when the cover is in place on the housing 204, as shown in FIG. 3, one support 230 is located at least partially in each projection 234. The actuator 208 has a circular shape and contains four magnets 236, 238, 240, 242, one of which is mounted in each of openings 244 in said actuator. The reed magnets are arranged in a generally square configuration and the magnets of the actuator have the same generally square configuration as said reed magnets. Adjacent magnets of said actuator have different polarities facing the housing. The magnets 236, 240 have a North polarity facing the actuator 206 and the magnets 238, 242 have a South polarity facing the actuator 206. Since the reed magnets 222, 224, 226, 228 all have the same polarity, in any one position of the actuator, two of the connectors are repelled and two of the connectors are attracted. The actuator has two distinct positions. In a first position, a first and third reed magnet is attracted and a second and fourth reed magnet is repelled. In a second position, a second and fourth reed magnet is attracted and a first and third reed magnet is repelled.

For example, if the reed magnets 222, 224, 226, 228 all have a North polarity, then two of the magnets of the actuator, magnets 236, 240 could also have a North polarity facing the housing 204. The magnets 238, 242 could then have a South polarity. The switch is designed so that a conductor path is connected when a reed magnet for that path is repelled by a corresponding magnet of the actuator. A magnet of the actuator is said to align with a magnet of the housing when the two magnets are aligned with one another. The wall 213 forms a wall of said housing and separates each of the reed magnets 224 from the actuator 208, said housing being completely sealed from said actuator. The stepper motor 210 repositions the actuator by rotating it through 90° at one time. The motor can rotate in the same direction through each step or back and forth, as desired.

Figure 5:
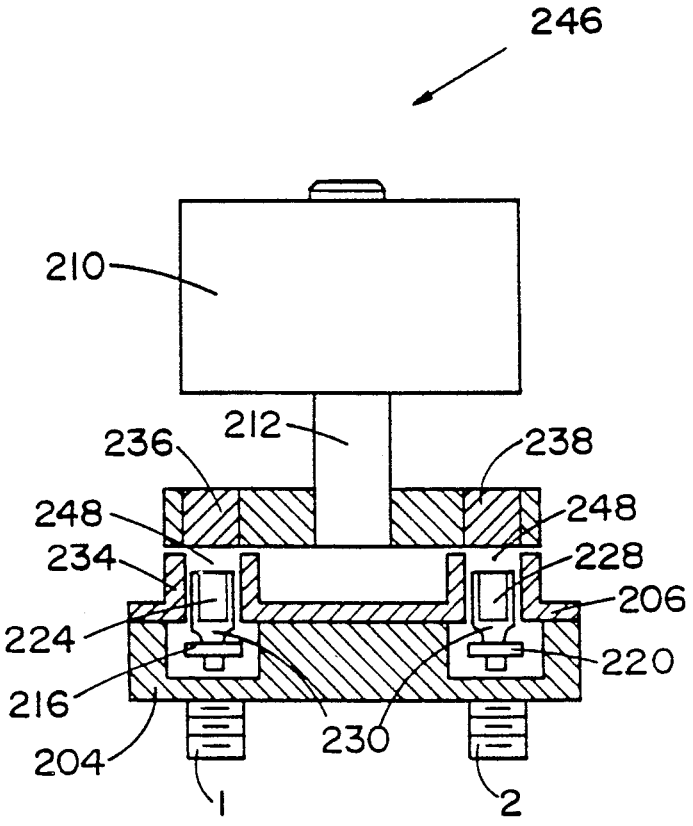
FIG. 5 is a sectional side view of an S-switch in accordance with the present invention wherein the housing has a series of openings on a side adjacent to the actuator.

Referring to FIG. 5 in greater detail, a coaxial S-switch 246 is virtually identical to the switch 200 except that the magnetically transparent wall 213 has been removed. The same reference numerals are used in FIG. 5 to identify those components that are similar or identical to those of FIG. 3. There are a series of openings 248 in a top of each of the cylindrical projections 234 between each of the reed magnets 224, 228 and the actuator 208. While only two of the reed magnets are shown in FIG. 5, the openings 248 will preferably be located in the tops of all of the projections 234 above all four reed magnets. The embodiment shown in FIG. 5 will be useful where the loss of electromagnetic energy through the openings is unimportant and the absence of the wall 213 (shown in FIG. 3) will provide greater attraction and repulsion between the reed magnets of the housing and the magnets of the actuator.

Figure 6:
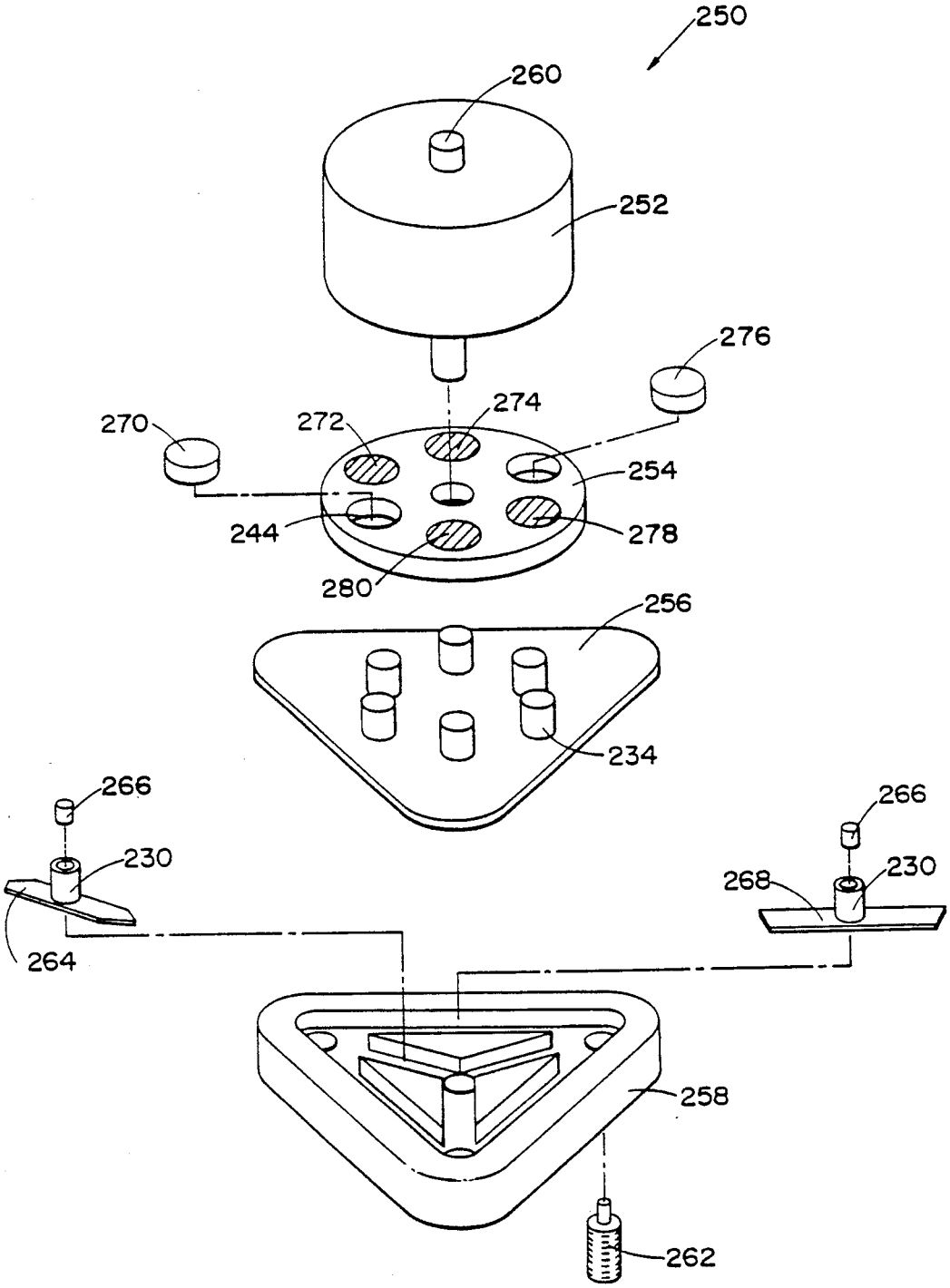
FIG. 6 is an exploded perspective view of a coaxial T-switch in accordance with the present invention.

In FIG. 6, there is shown a T-switch 250 having a motor 252, an actuator 254, a cover 256 and a housing 258. The motor 252 has a shaft 260. As can be seen, the housing 258, which includes the cover 256, has six conductor paths, three along the periphery of the housing and three radially extending from a centre of the housing. The switch 250 has four ports 262, only one of which is shown. There are three short connectors 264 having supports 230 and reed magnets 266, only one of which is shown. The short connectors 264 are designed to be placed in the radial connecting paths. There are also three long connectors 268, also containing supports 230 and reed magnets 266, only one of which is shown. The long connectors 268 are designed to be located in the conductor paths along a periphery of the housing 258. As with the switch 200, the cover 256 has one cylindrically-shaped projection 234 thereon for receiving each of the reed magnets 266 and the supports 230. The actuator 254 contains a total of six magnets, 270, 272, 274, 276, 278, 280 which are each mounted in an opening 244.

The polarity of all of the reed magnets will be identical. If the reed magnets 266 of the switch 250 have a North polarity, the magnets 270, 276 can also have a North polarity facing the housing 258. The remaining magnets 272, 274, 278, 280 of the actuator can then have a South polarity.

The T-switch 250 has three distinct positions. When the actuator is in a first position, the magnets 270, 276 will repel the reed magnet of a first long connector 268 and the reed magnet of a first short connector 264 normal thereto, thereby completing the connection in the conductor paths in which said connectors are located. Ports 1, 2 are connected and ports 3, 4 are connected in this position. The remaining reed magnets and connectors will be attracted to the remaining four magnets and the conductor paths in which these connectors are located will be interrupted. In a second position of the actuator, a second long connector and a second short connector normal thereto will be repelled and the remaining connectors will be attracted. Ports 2, 3 are connected and ports 1, 4 are connected in this position.

Similarly, in a third position of the actuator 254, a third long connector 268 and a third short connector 264 normal thereto will be repelled and the remaining connectors will be attracted. Ports 3, 1 are connected and ports 2, 4 are connected in this position. In all three positions, the same magnets 270, 276 will cause the corresponding reed magnets to be repelled and, therefore, the conductor path to be connected.

It has been found that in a T-switch, the three reed magnets for the long connectors are located in a circular format. Similarly, the reed magnets for the short connectors are located in a somewhat smaller circular format. By sufficiently enlarging the magnets of the actuator 254, an outside portion of each magnet of the actuator is able to interact with the larger circle formed by the reed magnets and an inside portion of each magnet of the actuator is able to interact with the smaller circle formed by the reed magnets.

While the magnets of the actuator for the switches 200, 250, have been described as having particular polarities, several different polarities and also different patterns or arrangements of the magnets are possible depending on the manner in which one desires a particular switch to operate. The connectors have been described as connecting the conductor path in which they are located when the reed magnet is repelled by the corresponding magnet of the actuator. In some situations, it can be beneficial to have the conducting path connect by attraction of the magnets rather than repulsion.

Figure 7:
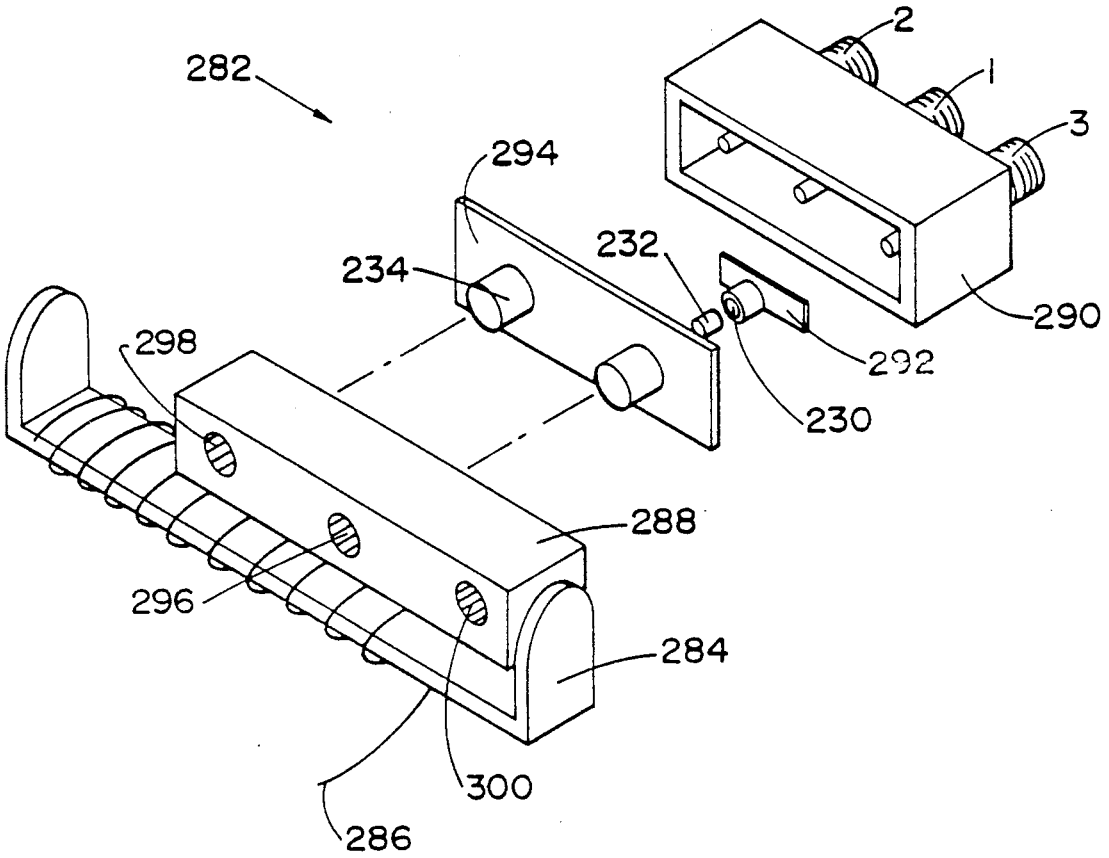
FIG. 7 is an exploded perspective view of a coaxial C-switch having an actuator operated by a solenoid.

In FIG. 7, there is shown an exploded perspective view of a C-switch 282 that is operated by a solenoid 284 having coils 286. An actuator 288 is slidable back and forth and has two distinct positions. An RF cavity housing 290 has three ports 1, 2, 3 and two conductor paths. A connector 292 has a support 230, a reed magnet 232 and is located in the conductor path between port 1 and port 3. An identical connector, support and reed magnet having the same polarity is located (but not shown in the drawing) in the conductor path between port 1 and port 2. The housing 290 includes a cover 294 having cylindrically-shaped projections 234 to receive the reed magnet and support of each of the connectors. On the basis that the two reed magnets 232 (only one of which is shown in FIG. 7) have a North polarity facing the actuator, the actuator 288 has three magnets 296, 298, 300. The magnet 296 of the actuator has a North polarity facing the housing 290. The remaining two magnets 298, 300 have a South polarity facing the housing 290. The switch 282 is designed so that the conductor paths are connected when the reed magnets 232 are repelled and interrupted when the reed magnets 232 are attracted to the magnets of the actuator.

In a first position shown in FIG. 7, the magnet 296 will repel a corresponding magnet 232 and therefore the connector 292 will connect the conductor path between port 1 and port 3. Simultaneously, the magnet 298 will attract the corresponding magnet 232 and therefore the connector 292 (not shown in FIG. 7) will interrupt the conductor path between port 1 and port 2. When the solenoid is activated to shift the actuator linearly to the left from the position shown in FIG. 7, in a second position of the actuator, the magnet 296 will then correspond to the reed magnet 232 that is not shown in FIG. 7, thereby repelling that magnet and the connector 292 (also not shown in FIG. 7) and the conductor path between port 1 and port 2 will be connected. Simultaneously, the magnet 300 will correspond to the reed magnet 232 for the connector 292 between port 1 and port 3, thereby interrupting that conductor path. When the solenoid is reactivated, the actuator will shift back to the first position.

Figure 8:
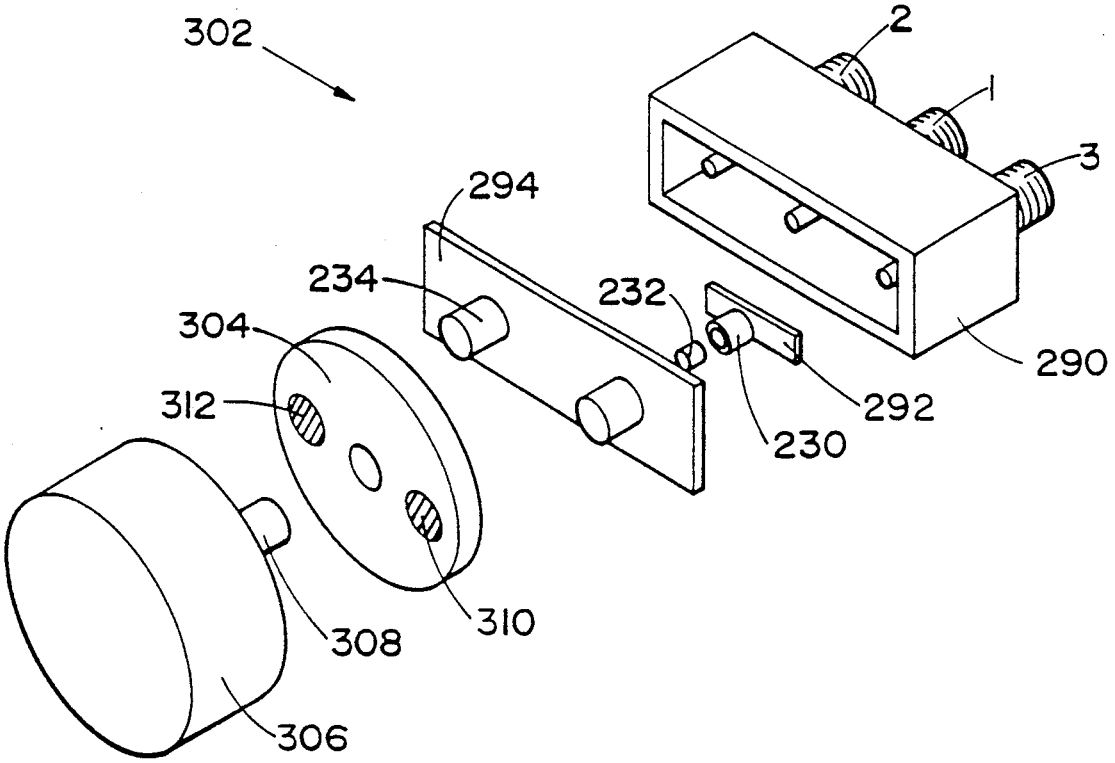
FIG. 8 is an exploded perspective view of a C-switch having a rotary actuator activated by a motor.
Figure 9:
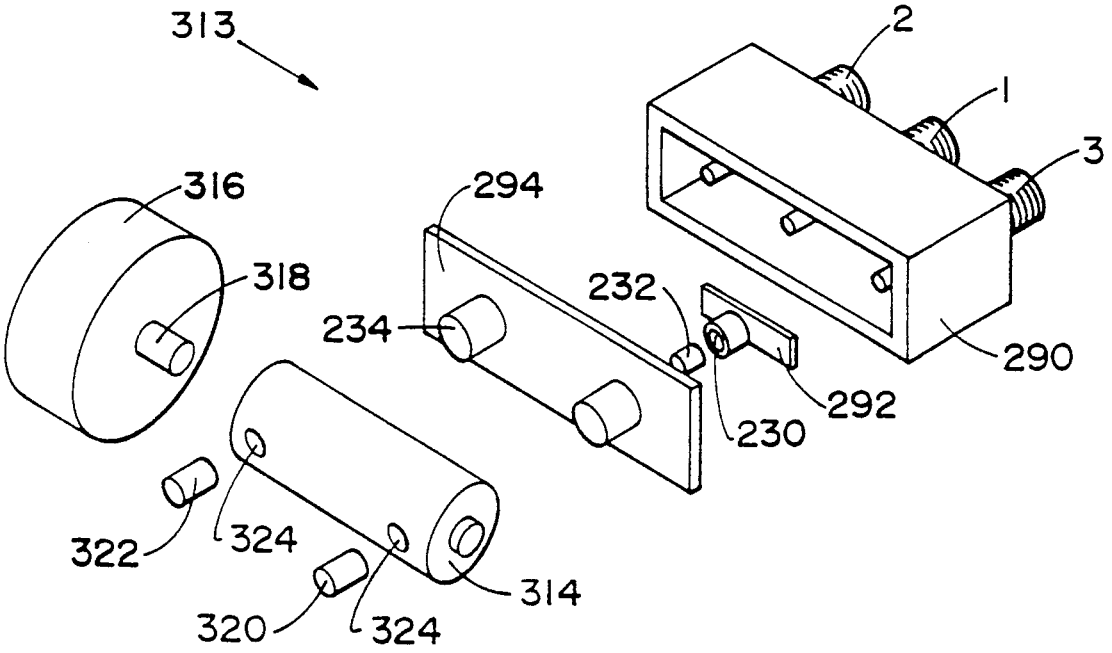
FIG. 9 is an exploded perspective view of a C-switch having a cylindrically-shaped actuator activated by a motor.

FIGS. 8 and 9 show further embodiments of C-switches. Those components of FIGS. 8 and 9 that are identical to the components of FIG. 7 are identified with the same reference numeral. The C-switches shown in FIGS. 8 and 9 differ with respect to the actuators.

In FIG. 8, a C-switch 302 has a circular rotatable actuator 304 which is moved from a first position to a second position by a stepper motor 306 having a shaft 308. Each time the stepper motor moves the actuator, the actuator rotates through 180°. Just like FIG. 7, there is a second connector 292, support 230 and magnet 232 located in the conductor path between Ports one and two which is not shown in FIG. 8. Magnets 310, 312 of the actuator 304 have the opposite polarity facing the housing 290. Since the two reed magnets 232 (only one of which is shown) have the same polarity, it can readily be understood that when the magnet 310 has a North polarity facing the housing 290 and the reed magnets also have a North polarity facing the actuator 310, the switch 302 will operate in identical fashion through a first and second position as already described for the switch 282.

In FIG. 9, a C-switch 313 has an actuator 314 with a cylindrical shape. The actuator 314 is activated by a stepper motor 316 having a shaft 318 that is connected to the actuator 314. Magnets 320, 322 are mounted in suitable openings 324 in the actuator 314. The magnets 320, 322 have opposite polarities towards an exterior of the actuator 314. The openings 324 can extend entirely through the actuator 314 and the magnets 320, 322 can be long enough so that a North polarity is located at one side of the actuator and a South polarity at the opposite side of the actuator for one magnet while the other magnet is mounted in a reversed position. Alternatively, the magnets 320, 322 could be shorter so that they extend only partially through the actuator 314 and a second set of magnets of opposite polarity could be mounted in the opposite side (not shown in FIG. 9) of said actuator. In a further variation of the actuator 314, at least one of the magnets could be closer to the surface of the actuator on one side than it is on the other side in order to vary the force on the corresponding reed magnet from one actuator position to the other.

Just like the switches 282, 302, the switch 313 has a second connector 292, support 230 and reed magnet 232 located in the conductor path between Ports one and two that is not shown in FIG. 9. Each activation of the stepper motor 316 rotates the cylindrical actuator 314 by 180°. If the two reed magnets 232 of the housing 290 have a North polarity facing the actuator 314 and the magnet 320 has a North polarity facing the housing 290 in the position shown in FIG. 9, then the magnet 324 will have a South polarity facing the housing 290. The switch 313 will then operate identically to the switch 282 when the stepper motor 316 is activated to rotate the actuator 314 through 180°.

It has been found that when a T-switch or C-switch is made in accordance with the present invention, the switch can be made small enough to have a cross-sectional area normal to an axis of movement of the reed magnets of substantially 0.95 square inches. In some designs, a switch can have a smaller motor as some of the detent force required to maintain the actuator in position can be provided by the magnetic force between the magnets of the actuator and the housing.

The connectors can be made of various materials that will be suitable, including, without limitation, a conducting plastic material. Numerous variations within the scope of the attached claims will be readily apparent to those skilled in the art.

What we claim as our invention is:

1. A microwave switch comprising an RF cavity housing, an actuator and a power means for repositioning said actuator arranged as follows:

(a) said housing having at least two conductor paths interconnecting at least three ports, said housing also containing at least two permanent reed magnets of the same polarity, said reed magnets each having a separate connector thereon, each connector having a first position and a second position that are linearly displaced from one another, in one position each connector connecting a conductor path in which said connector is located while in another position each connector interrupting said conductor path;

(b) said actuator having at least two permanent magnets, at least one of said permanent magnets being of opposite polarity to at least one other of said permanent magnets;

(c) said reed magnets of said housing and said permanent magnets of said actuator being located to interact with one another when the actuator is in an appropriate position so that one magnet of said actuator is aligned with a corresponding magnet of said housing;

(d) said magnets of said actuator being arranged with respect to polarity so that when the actuator is moved by the power means to one position, at least one magnet of said actuator attracts a corresponding reed magnet of said housing, thereby causing the connector to either connect or interrupt one conductor path while, simultaneously, another magnet of the actuator repels a corresponding reed magnet of the housing, thereby causing the connector to either interrupt or connect respectively another conductor path;

the movement of all magnets being co-ordinated so that appropriate conductor paths are connected and interrupted simultaneously, the actuator, the power means, the reed magnets and the connectors being the only movable components of the switch, there being no mechanical connection between the magnets of the actuator and the magnets of the housing.

2. A microwave switch as claimed in claim 1 wherein the housing contains a series of openings between each of the reed magnets and the actuator.

3. A microwave switch as claimed in claim 1 wherein the housing contains a magnetically transparent wall, forming a wall of said housing, separating each of the reed magnets from the actuator, said housing being completely sealed from said actuator.

4. A microwave switch as claimed in claim 1 wherein the actuator has a circular shape and the power means is a motor, the motor repositioning the actuator by rotating the actuator.

5. A microwave switch as claimed in any one of claims 2, 3 or 4 wherein the switch is an S-switch and the housing contains four conductor paths, four ports, four reed magnets and four connectors, said connectors and said reed magnets being arranged in a generally square configuration with each reed magnet being connected to a separate connector, said actuator containing four magnets arranged in the same generally square configuration as said reed magnets, the magnets of said actuator having different polarities facing said housing so that two of the magnets have a North polarity and two of the magnets have a South polarity, said actuator having two distinct positions, in any one position two of the reed magnets being attracted and simultaneously two of the reed magnets being repelled by the permanent magnets of said actuator.

6. A microwave switch as claimed in any one of claims 2, 3 or 4 wherein the switch is an S-switch and the housing contains four conductor paths, four ports, four reed magnets and four connectors, said connectors and said reed magnets being arranged in a generally square configuration, said actuator containing four magnets arranged in the same generally square configuration as said reed magnets, adjacent magnets of said actuator having different polarities facing said housing so that every second magnet of said actuator has a North polarity with a magnet having a South polarity located in between the magnets having a North polarity, said actuator having two distinct positions, in any one position two of the reed magnets being attracted and simultaneously two of the reed magnets being repelled by the permanent magnets of said actuator, in a first position, a first and third reed magnet being repelled and in a second position, a second and fourth reed magnet being repelled.

7. A microwave switch as claimed in any one of claims 2, 3 or 4 wherein the switch is a C-switch and the housing contains two conductor paths, three ports, two reed magnets and two connectors, each reed magnet being connected to a separate connector, one connector connecting ports one and two and the other connector connecting ports two and three, said actuator also containing two permanent magnets arranged to correspond to said reed magnets, said magnets of said actuator having opposite polarities so that one magnet has a South polarity and the other magnet has a North polarity, said actuator having two distinct positions, in a first position, first and third reed magnets being attracted and simultaneously second and fourth reed magnets being repelled, and, in a second position, second and fourth reed magnets being attracted and first and third reed magnets being repelled.

8. A microwave switch as claimed in any one of claims 2, 3 or 4 wherein the switch is a T-switch and the housing contains six conductor paths, four ports, six reed magnets and six connectors, each reed magnet being connected to a separate connector, one connector connecting ports one and two, one connector connecting ports two and three, one connector connecting ports one and three, one connector connecting ports one and four, one connector connecting ports two and four and one connector connecting ports three and four, said actuator also containing six permanent magnets arranged to correspond to said reed magnets, said magnets of said actuator having opposite polarities, said actuator having at least three distinct positions, in each position, one or more reed magnets being attracted and one or more reed magnets being repelled.

9. A microwave switch as claimed in any one of claims 2, 3 or 4 wherein the switch is a T-switch and the housing contains six conductor paths, four ports, six reed magnets and six connectors, each reed magnet being connected to a separate connector, one connector connecting ports one and two, one connector connecting ports two and three, one connector connecting ports one and three, one connector connecting ports one and four, one connector connecting ports two and four and one connector connecting ports three and four, said actuator also containing six permanent magnets arranged to correspond to said reed magnets, said magnets of said actuator having opposite polarities, a first and second magnet and a fourth and fifth magnet of said actuator having one polarity facing said housing and a third and sixth magnet of said actuator having a different polarity facing said housing, said actuator having three distinct positions, in a first position said first and fourth reed magnets being repelled and the remaining reed magnets being attracted, in a second position said second and fifth reed magnets being repelled and the remaining magnets being attracted, in a third position, said third and sixth reed magnets being repelled and said remaining reed magnets being attracted.

10. A microwave switch as claimed in any one of claims 1, 2 or 3 wherein the switch is a C-switch and the housing contains two conductor paths, three ports, two reed magnets and two connectors, each reed magnet being connected to a separate connector, one connector connecting ports one and two and one connector connecting ports one and three, said actuator containing three permanent magnets, said magnets of said actuator lying in a straight line and being spaced so that when the actuator moves longitudinally from a first position to a second position, two of the three magnets of said actuator correspond with the reed magnets of said housing, a centre magnet of said actuator having the same polarity as said reed magnets to repel said reed magnets and the remaining magnets of said actuator having an opposite polarity to said reed magnets to attract said reed magnets, said actuator having two distinct positions, in a first position, said first reed magnet being repelled and said second reed magnet being attracted, in a second position, said first reed magnet being attracted and said second reed magnet being repelled.

11. A microwave switch as claimed in any one of claims 1, 2 or 3 wherein the switch is a C-switch and the housing contains two conductor paths, three ports, two reed magnets and two connectors, each reed magnet being connected to a separate connector, one connector connecting ports one and two and one connector connecting ports one and three, said actuator being rotatable and containing two permanent magnets, said magnets being sized and located to correspond to said reed magnets, said actuator having two positions, in a first position, said first reed magnet being repelled and said second reed magnet being attracted, in a second position, said second position being the rotation of the actuator through 180°, the first reed magnet being attracted and the second reed magnet being repelled.

12. A microwave switch as claimed in any one of claims 1, 2 or 3 wherein the switch is a C-switch and the housing contains two conductor paths, three ports, two reed magnets and two connectors, each reed magnet being connected to a separate connector, one connector connecting ports one and two and one connector connecting ports one and three, said actuator having a cylindrical shape and containing magnets on opposite sides of an outer surface thereof, there being two magnets on one side of the cylindrical actuator and two magnets on the other side of the cylindrical actuator, the magnets on the same side of the actuator having different polarities, means for rotating the cylindrical actuator about its longitudinal axis, the magnets of said actuator being sized and located to correspond to the reed magnets, said actuator having two distinct positions, in a first position, said first reed magnet being repelled and said second reed magnet being attracted and, in a second position, said second position being attained by rotating said actuator 180° about its longitudinal axis, said first reed magnet is attracted and said second reed magnet is repelled.

13. A microwave switch as claimed in any one of claims 2, 3 or 4 wherein the switch is selected from the group of a C-switch or a T-switch and has a cross-sectional area normal to an axis of movement of the reed magnets of substantially 0.95 square inches.

14. A microwave switch as claimed in any one of claims 2, 3 or 4 wherein a conductor path is connected when the reed magnet for the connector for that path is repelled and interrupted when the reed magnet for that path is attracted.

15. A microwave switch as claimed in any one of claims 2, 3 or 4 wherein a magnetic force between magnets of the actuator and housing that are attracted to one another provides at least some of a detent force required to maintain the switch in a particular position.

16. A microwave switch as claimed in any one of claims 2, 3 or 4 wherein each of the reed magnets and supports are located approximately in a longitudinal centre of each connector.

* * * * *